US005349978A

United States Patent [19]

Sago et al.

[11] Patent Number: 5,349,978

[45] Date of Patent: Sep. 27, 1994

[54] CLEANING DEVICE FOR CLEANING PLANAR WORKPIECE

[75] Inventors: Hiroyoshi Sago; Shigemi Fujiyama; Katsuhiko Kudo; Hirotsugu Kumazawa, all of Kanagawa, Japan

[73] Assignee: Tokyo Ohka Kogyo Co., Ltd., Kanagawa, Japan

[21] Appl. No.: 72,142

[22] Filed: Jun. 4, 1993

[30] Foreign Application Priority Data

Jun. 4, 1993 [JP] Japan ..... 4-170246

[51] Int. Cl.[5] ..... B08B 3/02

[52] U.S. Cl. ..... 134/153; 134/164; 134/902

[58] Field of Search ..... 68/147, 153, 902, 164, 68/161

[56] References Cited

U.S. PATENT DOCUMENTS

| | | | |
|---|---|---|---|
| 4,788,994 | 12/1988 | Shinbara | 134/902 |
| 4,790,262 | 12/1988 | Nakayama et al. | 134/153 |
| 4,838,289 | 6/1987 | Kottman | 134/153 |

FOREIGN PATENT DOCUMENTS

| | | | |
|---|---|---|---|
| 3-178121 | 8/1981 | Japan | 134/902 |
| 62-188323 | 8/1987 | Japan | 134/902 |
| 63-185029 | 7/1988 | Japan | 134/902 |
| 64-23539 | 1/1989 | Japan | 134/902 |
| 4-2117 | 1/1992 | Japan | 134/902 |

*Primary Examiner*—Frankie L. Stinson

*Attorney, Agent, or Firm*—Irving M. Weiner; Joseph P. Carrier; Pamela S. Burt

[57] ABSTRACT

A cleaning device has a pair of diametrically opposite nozzles spaced across a rotatable chuck from each other for alternately applying a cleaning solution to the reverse side of a workpiece. The rotatable chuck with the workpiece held thereon is rotated by a reversible motor alternatively in opposite directions such that the cleaning solution is ejected from one of the nozzles while the rotatable chuck is being rotated in one of the opposite directions by the reversible motor, and the cleaning solution is ejected from the other of the nozzles while the rotatable chuck is being rotated in the other of the opposite directions by the reversible motor. The nozzles have respective axes along which the cleaning solution is ejected, the axes extending symmetrically with respect to a line passing through the center of the rotatable chuck perpendicularly to a line connecting the pair of nozzles.

19 Claims, 5 Drawing Sheets

CLEANING DEVICE FOR CLEANING PLANAR WORKPIECE

BACKGROUND OF THE INVENTION

1. Field of the Invention

The present invention relates to a cleaning device for cleaning a planar workpiece, and more particularly to a cleaning device for cleaning the reverse side of a planar workpiece whose face side is coated with a coating solution.

2. Description of the Prior Art

To form a resist layer on the face side of a planar workpiece such as a glass substrate, a semiconductor wafer, or the like, it has been customary to apply a resist solution to the face side of the planar workpiece with a coating apparatus and then heat the applied resist solution with a hot plate or the like. When the resist solution is applied to the face side of the planar workpiece by the coating apparatus, a small amount of the applied resist solution tends to spread to the edge and reverse side of the planar workpiece due to surface tension. If the applied resist solution were heated with the spread resist solution unremoved, then the spread resist solution on the edge and reverse side of the planar workpiece would be dried into solid particles, which would be subsequently scattered around and deposited on the coated resist layer. As a result, the coated planar workpiece would be defective, and/or the yield of coated planar workpieces would be low.

Japanese laid-open utility model publication No. 3-47070 discloses a spinner device which applies a coating solution to a workpiece which is being rotated by a chuck that holds the workpiece. The spinner device has a pair of diametrically opposite nozzles disposed below the workpiece for applying a cleaning solution to remove any applied coating solution off the reverse side of the workpiece.

SUMMARY OF THE INVENTION

It is an object of the present invention to provide a device for uniformly and efficiently cleaning the reverse side of a planar workpiece whose face side is coated with a coating solution.

According to an aspect of the present invention, there is provided a cleaning device for cleaning a planar workpiece, comprising a rotatable chuck for holding the planar workpiece thereon, nozzle means for applying a cleaning solution to the peripheral edge on the reverse side of the workpiece, and actuator means for rotating the rotatable chuck with the workpiece held thereon alternatively in opposite directions while the cleaning solution is being applied to the peripheral edge on the reverse side of the workpiece by the nozzle means. The nozzle means may comprise a pair of nozzles disposed on a concentric circle about the rotatable chuck, the nozzle having respective axes along which the cleaning solution is ejected, the axes extending symmetrically with respect to a line passing through the center of the rotatable chuck perpendicularly to a line connecting the pair of nozzles. The nozzle means may also comprise means for ejecting the cleaning solution simultaneously from the nozzles while the rotatable chuck with the workpiece held thereon is being rotated alternately in the opposite directions. Alternatively, the nozzle means may also comprise means for ejecting the cleaning solution alternately from the nozzles while the rotatable chuck with the workpiece held thereon is being rotated alternately in the opposite directions.

The pair of nozzles may be diametrically spaced across the rotatable chuck from each other, the axes being substantially aligned with a line passing through the center of the rotatable chuck and the nozzles. The pair of nozzles may also be diametrically spaced across the rotatable chuck from each other, one of the axes being angularly displaced in one direction from a line passing the center of the rotatable chuck and the nozzles, and the other of the axes being angularly displaced in the opposite direction from the line passing the center of the rotatable chuck and the nozzles. The pair of nozzles may further be spaced such that the line connecting the pair of nozzles does not pass through the rotatable chuck, the axes extending substantially perpendicularly to the line connecting the pair of nozzles.

According to another aspect of the present invention, there is also provided a cleaning device for cleaning a reverse side of planar workpiece whose face side is coated with a coating solution, comprising a rotatable chuck for holding the planar workpiece thereon, a pair of nozzles disposed on a concentric circle about the rotatable chuck for applying a cleaning solution to the reverse side of the workpiece, and actuator means for rotating the rotatable chuck with the workpiece held thereon alternatively in opposite directions while the cleaning solution is being applied to the reverse side of the workpiece by the nozzle means. The nozzles may be actuatable either simultaneously or alternately to apply the cleaning solution to the reverse side of the workpiece, the nozzles may have respective axes along which the cleaning solution is ejected, the axes extending symmetrically with respect to a line passing through the center of the rotatable chuck perpendicularly to a line connecting the pair of nozzles.

According to still another aspect of the present invention, there is further provided a cleaning device for cleaning a reverse side of planar workpiece whose face side is coated with a coating solution, comprising a rotatable chuck for holding the planar workpiece thereon, a pair of diametrically opposite nozzles spaced across the rotatable chuck from each other for alternately applying a cleaning solution to the reverse side of the workpiece, and actuator means for rotating the rotatable chuck with the workpiece held thereon alternatively in opposite directions such that the cleaning solution is ejected from one of the nozzles while the rotatable chuck is being rotated in one of the opposite directions by the actuator means, and the cleaning solution is ejected from the other of the nozzles while the rotatable chuck is being rotated in the other of the opposite directions by the actuator means, the nozzles having respective axes along which the cleaning solution is ejected, the axes extending symmetrically with respect to a line passing through the center of the rotatable chuck perpendicularly to a line connecting the pair of nozzles.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
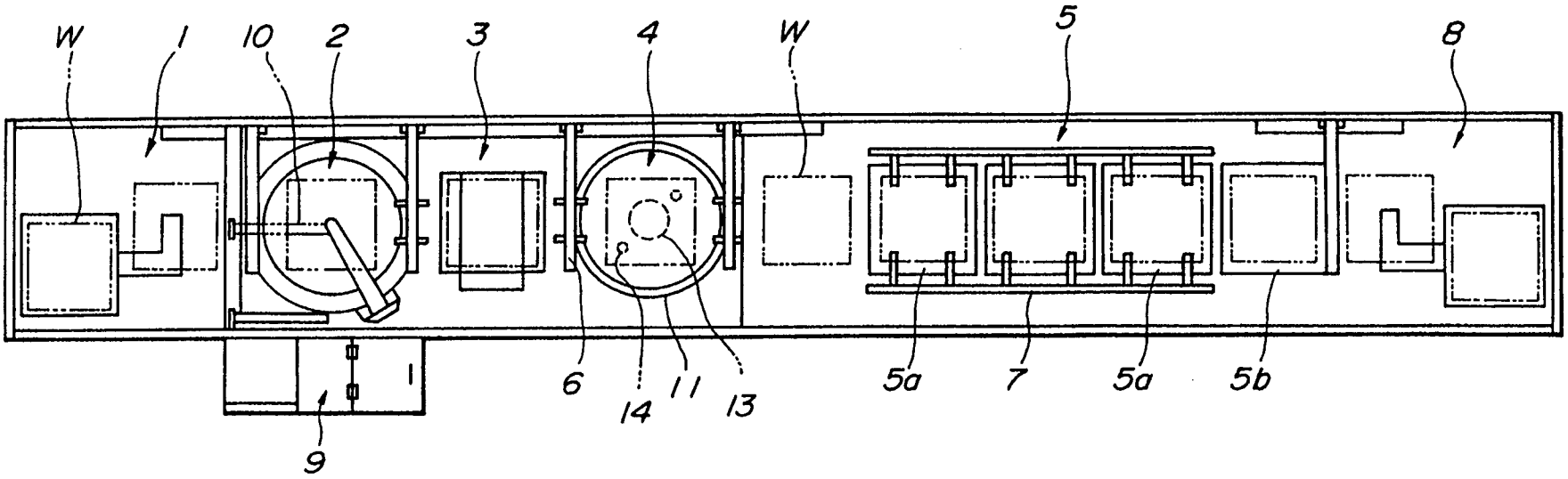
FIG. 1 is a plan view of a coating system which incorporates a cleaning device for cleaning the reverse side of a planar workpiece according to an embodiment of the present invention.

As shown in FIG. 1, a coating system is of an elongate configuration for coating a workpiece as it is fed from the left end to the right end. The coating system includes a charging zone 1 at its left or upstream end for charging a planar workpiece W such as a glass substrate, a semiconductor wafer, or the like. The coating system also has a coating device 2 disposed downstream of the charging zone 1, a vacuum drying device 3 disposed downstream of the coating device 2, a cleaning device 4 according to the present invention disposed downstream of the vacuum drying device 3, and a heating device 5 disposed downstream of the cleaning device 4 and comprising an array of hot plates 5*a* and a cooling plate 5*b*. The coating system further includes a first feeder 6 for feeding a planar workpiece W from the charging zone 1 successively through the coating device 2, the vacuum drying device 3, and the cleaning device 4 to the heating device 5 while supporting the lower surface, i.e., reverse side, of the planar workpiece W at its leading and trailing ends. In the heating device 5, the planar workpiece W is fed successively over the hot plates 5*a* by a second feeder 7 which supports the lower surface of the planar workpiece W and is actuatable for vertical cranking movement. After the planar workpiece W has been heated successively by the hot plates 5*a*, it is cooled by the cooling plate 5*b*, and then delivered to a discharging zone 8 at the downstream end of the coating system.

The coating system has a replaceable coating solution supply device 9 positioned in front of the coating device 2. The coating device 2 has a movable nozzle 10 which is supplied with a coating solution from the coating solution supply device 9. When the coating device 2 is in operation, the coating solution supplied to the movable nozzle 10 drops onto the upper surface, i.e., face side, of the planar workpiece W to form a uniform coating film thereon while the planar workpiece W is being rotated in the coating device 2.

After the uniform coating film has been formed on the upper surface of the planar workpiece W, the coated planar workpiece W is partly dried in a vacuum by the vacuum drying device 3. The coated planar workpiece W is thereafter fed to the cleaning device 4. At this time, as shown in FIG. 2, the applied coating solution, denoted by R, is spread to the outer peripheral end and the reverse side of the planar workpiece W near the peripheral edge.

Figure 2:
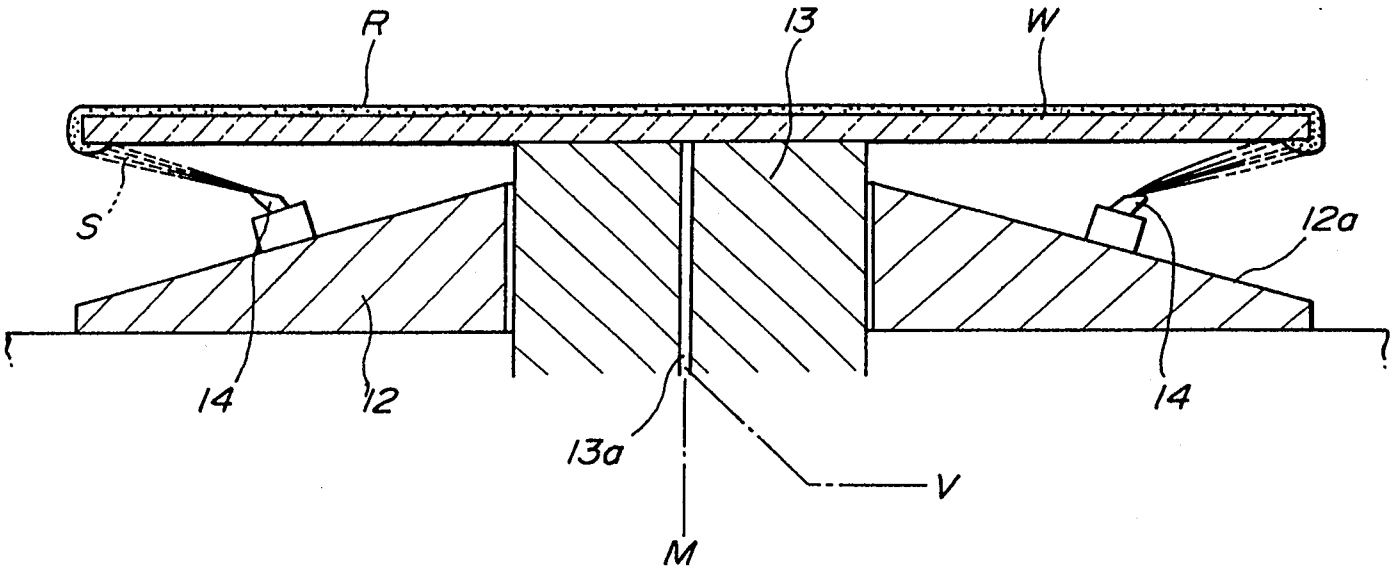
FIG. 2 is an enlarged vertical cross-sectional view of the cleaning device.
Figure 3:
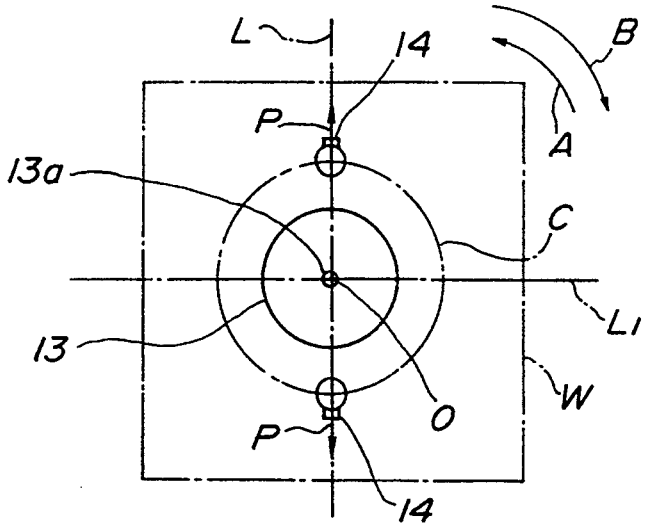
FIG. 3 is a plan view of the cleaning device.

As shown in FIGS. 1 through 3, the cleaning device 4 comprises a cup or casing 11 and a mount 12 disposed in the casing 11. A spin chuck 13 which is rotatable about its own axis by a reversible motor M (FIG. 2) extends vertically through the center of the mount 12. The mount 12 has an upper conical surface 12*a* on which there is mounted a pair of diametrically opposite nozzles 14 spaced across the spin chuck 13 for ejecting a cleaning solution S toward the peripheral edge of the planar workpiece W on the reverse side. Namely, the nozzles 14 are disposed on a concentric circle C about the spin chuck 13. The nozzles 14 are connected to a tank (not shown) containing the cleaning solution S.

The spin chuck 13 has a central vertical passage 13*a* defined therein and connected to a vacuum pump V, the central vertical passage 13*a* having an upper end opening at the upper end of the spin chuck 13. In operation, the planar workpiece W is attracted to the upper end of the spin chuck 13 under a vacuum developed in the central vertical passage 13*a* by the vacuum pump V, and is rotated selectively in opposite directions by the reversible motor M coupled to the spin chuck 13.

As shown in FIG. 3, each of the nozzles 14 has a central axis P along which the cleaning solution S is ejected, and the central axis P is substantially aligned with a line L that extends through the center O of the spin chuck 13 and the nozzles 14.

Figure 4:
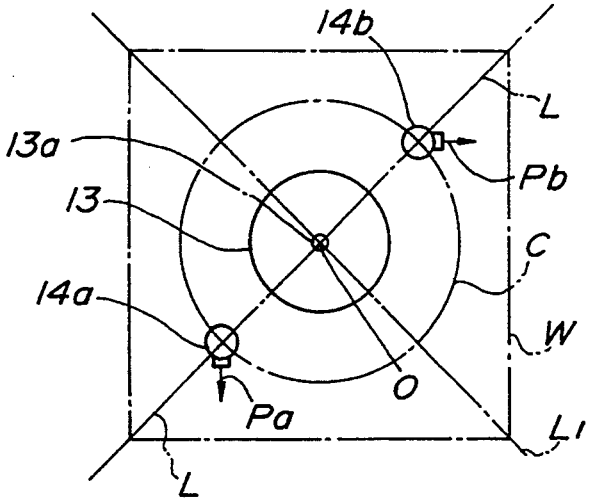
FIG. 4 is a plan view of a cleaning device according to another embodiment of the present invention.

FIG. 4 shows a cleaning device according to another embodiment of the present invention. The cleaning device shown in FIG. 4 differs from the cleaning device shown in FIG. 3 in that diametrically opposite first and second nozzles 14*a*, 14*b* mounted on the mount 12 on a concentric circle C about the spin chuck 13 are selectively actuatable and are directed 90 degrees offset from each other, or in opposite directions when viewed radially outwardly from the center of the rotatable chuck toward the nozzles, respectively. More specifically, the first nozzle 14*a* is actuated to eject a cleaning solution when the spin chuck 13 and hence the planar workpiece W are rotated in one direction by the motor M, and the second nozzle 14*b* is actuated to eject a cleaning solution when the spin chuck 13 and hence the planar workpiece W are rotated in the opposite direction by the motor M. The first nozzle 14*a* has a central axis Pa along which the cleaning solution S is ejected, and the second nozzle 14*b* has a central axis Pb along which the cleaning solution S is ejected. The central axes Pa, Pb of the first and second nozzles 14*a*, 14*b* are directed in offset or opposite directions out of alignment with the line L passing through the center O of the spin chuck 13 and the first and second nozzles 14*a*, 14*b*, as discussed above. Specifically, the central axis Pa of the first nozzle 14*a* is angularly displaced to the left from the line L as viewed along the line L from the center O of the spin chuck 13 to the first nozzle 14*a*, and the central axis Pb of the second nozzle 14*b* is angularly displaced placed to the right from the line L as viewed along the line L from the center O of the spin chuck 13 to the second nozzle 14*b*. It should be noted that in this arrangement, the axes Pa, Pb extend symmetrically with respect to a line L1 passing through the center of the rotatable chuck 13 perpendicularly to the line L passing through the nozzles 14*a*, 14*b*.

The coating solution R that has dropped on the upper surface of the planar workpiece W in the coating device 2 is spread radially outwardly under centrifugal forces to the peripheral edge and the reverse side of the planar workpiece W near the peripheral edge. After the coating solution R has been partly dried by the vacuum drying device 3, the excessive coating solution R on the outer peripheral end and the peripheral edge on the reverse side of the planar workpiece W is removed by the cleaning solution S ejected by the cleaning device 4.

Figure 5:
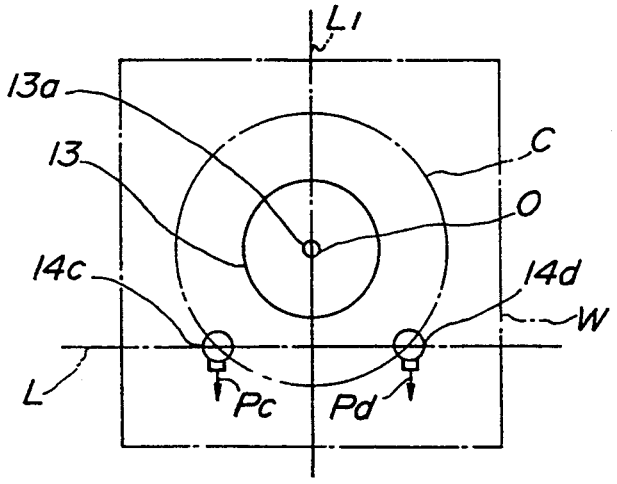
FIG. 5 is a plan view of a cleaning device according to a further embodiment of the present invention.

FIG. 5 shows a cleaning device according to a further embodiment of the present invention. The cleaning device shown in FIG. 5 differs from the cleaning device shown in FIG. 4 in that first and second nozzles 14*c*, 14*d* are disposed on a concentric circle C about the rotatable chuck 13 in such a manner that a line L extending through the nozzles 14*c*, 14*d* does not pass through the rotatable chuck 13.

The first and second nozzles 14*c* and 14*d* have respective central axes Pc and Pd along which the cleaning solution S is ejected. The central axes Pc, Pd are directed substantially perpendicularly to the line L passing through the first and second nozzles 14*c*, 14*d*, and extend symmetrically and in parallel with respect to a line L1 passing through the center of the rotatable chuck perpendicularly to the line L.

Cleaning operation of the cleaning device 4 with the nozzles 14 will be described below with reference to FIG. 3. In FIG. 3, the planar workpiece W is of a square shape such as a glass substrate. When the spin chuck 13 is rotated in the direction indicated by the arrow A in FIG. 3, the nozzles 14 eject the cleaning solution S to apply it to the rotating workpiece W. When the spin chuck 13 is then rotated in the direction indicated by the arrow B in FIG. 3, the nozzles 14 also eject the cleaning solution S to apply it to the rotating workpiece W. Therefore, while the cleaning solution S is applied to the workpiece W by the nozzles 14, the workpiece W is rotated alternately in the opposite directions. The applied cleaning solution S is thus distributed evenly on the workpiece W to remove the excessive coating solution R off the workpiece W. Only one of the nozzles 14 may be actuated to eject the cleaning solution S when the spin chuck 13 is rotated in the direction A, and the other nozzle 14 may be actuated to eject the cleaning solution S when the spin chuck 13 is rotated in the direction B.

Figure 6:
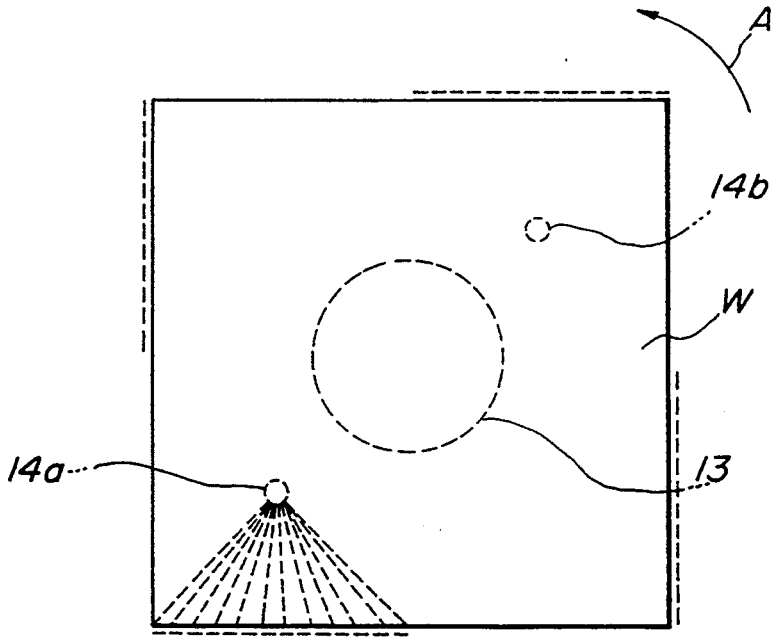
FIGS. 6(*a*) and 6(*b*) are plan views showing the manner in which the cleaning device cleans a workpiece.
Figure 6:
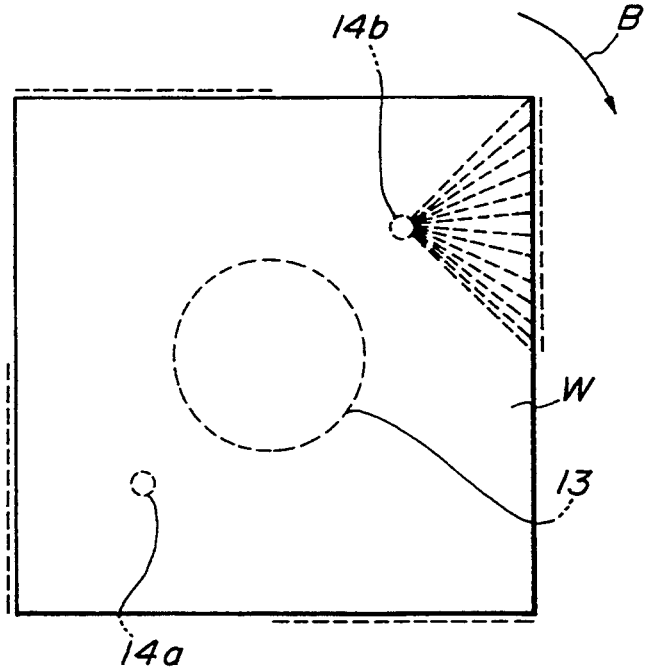

Cleaning operation of the cleaning device 4 with the first and second nozzles 14*a*, 14*b* shown in FIG. 4 will be described below with reference to FIGS. 6(*a*) and 6(*b*). In FIGS. 6(*a*) and 6(*b*), the planar workpiece W is of a square shape. When the spin chuck 13 is rotated in the direction indicated by the arrow A in FIG. 6(*a*), only the first nozzle 14*a* ejects the cleaning solution S to apply the cleaning solution S intensively to those portions of the sides of the workpiece W which are positioned downstream of the other portions of the sides with respect to the direction A. While the workpiece W is rotating in the direction A, the cleaning solution S is liable to stay on those downstream portions of the sides of the workpiece W. Conversely, when the spin chuck 13 is rotated in the direction indicated by the arrow B in FIG. 6(*b*), only the second nozzle 14*b* ejects the cleaning solution S to apply the cleaning solution S intensively to those portions of the sides of the workpiece W which are positioned downstream of the other portions of the sides with respect to the direction B. The downstream portions of the sides of the workpiece W with respect to the direction B are the same as the upstream portions of the sides of the workpiece W with respect to the direction A. While the workpiece W is rotating in the direction B, the cleaning solution S is liable to stay on those downstream portions of the sides of the workpiece W. The alternate ejection of the cleaning solution S from the first and second nozzles 14*a*, 14*b* in timed relationship to the rotation of the workpiece W in one direction or the other is effective to apply the cleaning solution S equally to the sides of the workpiece W and hence to clean the workpiece W efficiently in a relatively short period of time.

Figure 7A:
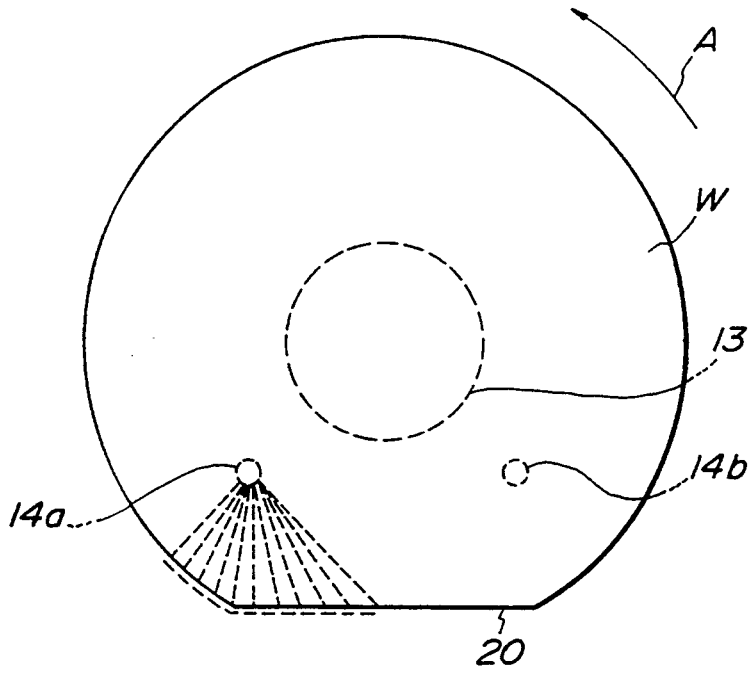
FIGS. 7(*a*) and 7(*b*) are plan views showing the manner in which the cleaning device cleans another workpiece.
Figure 7B:
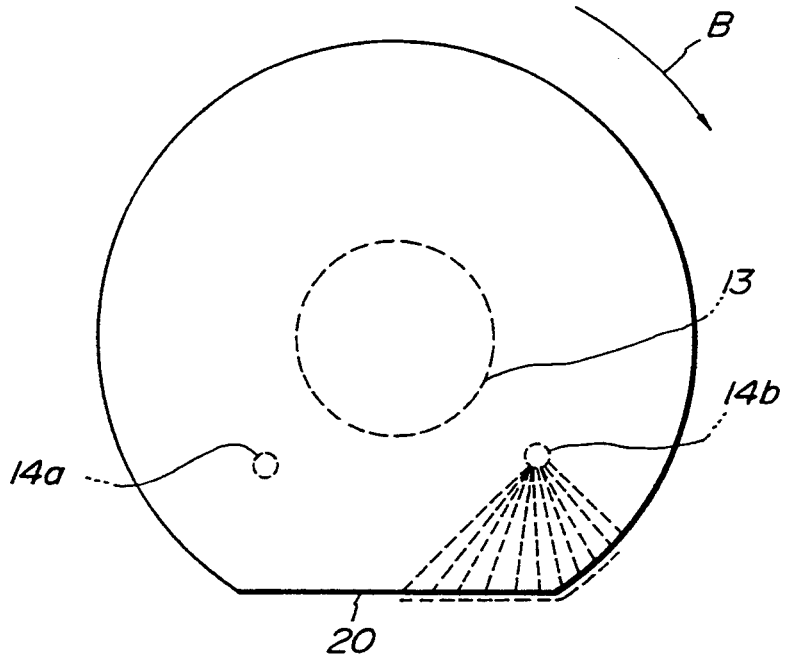

Cleaning operation of the cleaning device 4 with the first and second nozzles 14*c*, 14*d* shown in FIG. 5 will be described below with reference to FIGS. 7(*a*) and 7(*b*). In FIGS. 7(*a*) and 7(*b*), the planar workpiece W is of a circular shape such as a semiconductor (Si) wafer. The circular workpiece W has an orientation flat 20 in its peripheral edge for positioning the circular workpiece W. When the spin chuck 13 is rotated in the direction indicated by the arrow A in FIG. 7(*a*), only the first nozzle 14*c* ejects the cleaning solution S to apply the cleaning solution S intensively to the portion of the orientation flat 20 of the workpiece W which is positioned downstream of the other portion of the orientation flat 20 with respect to the direction A. While the workpiece W is rotating in the direction A, the cleaning solution S is liable to stay on the downstream portion of the orientation flat 20 of the workpiece W. When the spin chuck 13 is rotated in the direction indicated by the arrow B in FIG. 7(*b*), only the second nozzle 14*b* ejects the cleaning solution S to apply the cleaning solution S intensively to the portion of the orientation flat 20 of the workpiece W which is positioned downstream of the other portion of the orientation flat 20 with respect to the direction B. The downstream portion of the orientation flat 20 of the workpiece W with respect to the direction B is the same as the upstream portion of the orientation flat 20 of the workpiece W with respect to the direction A. While the workpiece W is rotating in the direction B, the cleaning solution S is liable to stay on the downstream portion of the orientation flat 20 of the workpiece W. By thus applying the cleaning solution S alternately from the first and second nozzles 14*a*, 14*b* during the rotation of the workpiece W in one direction or the other, the cleaning solution S is applied uniformly to the orientation flat 20 for removing the excessive coating solution R from the workpiece W.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

We claim:

1. A cleaning device for cleaning a planar workpiece, comprising:

a rotatable chuck for holding the planar workpiece thereon;

nozzle means for applying a cleaning solution to a peripheral edge on a reverse side of the workpiece; and actuator means for rotating said rotatable chuck with the workpiece held thereon alternately in opposite directions while the cleaning solution is being applied to the peripheral edge on the reverse side of the workpiece by said nozzle means;

said nozzle means applying said cleaning solution a in timed relationship relating to the alternate rotation of said chuck in opposite directions.

2. A cleaning device according to claim 1, wherein said nozzle means comprises a pair of nozzles disposed on a concentric circle about said rotatable chuck, said nozzles having respective axes along which the cleaning solution is ejected, said axes extending symmetrically with respect to a line passing through the center of said rotatable chuck perpendicularly to a line connecting said pair of nozzles.

3. A cleaning device according to claim 2, wherein said nozzle means comprises means for ejecting the cleaning solution simultaneously from said nozzles while said rotatable chuck with the workpiece held thereon is being rotated alternately in the opposite directions.

4. A cleaning device according to claim 2, wherein said nozzle means comprises means for ejecting the cleaning solution alternately from said nozzles while said rotatable chuck with the workpiece held thereon is being rotated alternately in the opposite directions.

5. A cleaning device according to claim 2, wherein said pair of nozzles are diametrically spaced across said rotatable chuck from each other, said axes being substantially aligned with said line connecting said pair of nozzles.

6. A cleaning device according to claim 2, wherein said pair of nozzles are diametrically spaced across said rotatable chuck from each other, one of said nozzle's axis being angularly displaced in one direction from a line passing through the center of said rotatable chuck and said nozzles as viewed along said line from the center of said rotatable chuck to said one nozzle, and the other of said nozzle's axis being angularly displaced in the opposite direction from said line connecting said pair of nozzles as viewed along said line from the center of said rotatable chuck to said other nozzle.

7. A cleaning device according to claim 2, wherein said pair of nozzles are spaced such that said line connecting said pair of nozzles does not pass through said rotatable chuck, said axes extending substantially perpendicularly to said line connecting said pair of nozzles.

8. A cleaning device according to claim 1, wherein said nozzle means comprises a pair of diametrically opposite nozzles spaced across said rotatable chuck from each other, and means for ejecting cleaning solution alternately from said nozzles while said rotatable chuck with said workpiece held thereon is being rotated alternately in opposite directions, said reverse side of said workpiece has at least one substantially flat peripheral edge, and said solution ejecting means being adapted to eject said cleaning solution on a portion of said substantially flat peripheral edge which is positioned downstream of other portions of the substantially flat peripheral edge with respect to the direction of rotation of the chuck.

9. A cleaning device according to claim 1, wherein said nozzle means intermittently applies said cleaning solution in said timed relationship.

10. A cleaning device for cleaning a reverse side of a planar workpiece whose face side is coated with a coating solution, comprising:

a rotatable chuck for holding the planar workpiece thereon;

a pair of nozzles disposed on a concentric circle about said rotatable chuck for applying a cleaning solution to a peripheral edge on the reverse side of the workpiece;

actuator means for rotating said rotatable chuck with the workpiece held thereon alternately in opposite directions while the cleaning solution is being applied to the reverse side of the workpiece by said nozzles; and means for applying the cleaning solution through said pair of nozzles in a timed relationship relating to the alternate rotation of said chuck in opposite directions.

11. A cleaning device according to claim 10, wherein said nozzles are actuatable simultaneously to apply the cleaning solution to the reverse side of the workpiece.

12. A cleaning device according to claim 10, wherein said applying means alternately actuates said nozzles in said timed relationship to apply the cleaning solution to the reverse side of the workpiece.

13. A cleaning device according to claim 10, wherein said pair of nozzles have respective axes along which the cleaning solution is ejected, said axes extending symmetrically with respect to a line passing through the center of said rotatable chuck perpendicularly to a line connecting said pair of nozzles.

14. A cleaning device according to claim 13, wherein said pair of nozzles are spaced across said rotatable chuck from each other, said axes being substantially aligned with a line passing through the center of said rotatable chuck and said nozzles.

15. A cleaning device according to claim 13, wherein said pair of nozzles are spaced across said rotatable chuck from each other, one of said nozzle's axis being angularly displace in one direction from a line passing through the center of said rotatable chuck and said nozzles as viewed along said line from the center of said rotatable chuck to said one nozzle, and the other of said nozzle's axis begin angularly displaced in the opposite direction from said line passing the center of said rotatable chuck and said nozzles as viewed along said line from the center of said rotatable chuck to said other nozzle.

16. A cleaning device according to claim 10, wherein said applying means ejects cleaning solution alternately from said nozzles while said rotatable chuck with the workpiece held thereon is being rotated alternately in opposite directions, said reverse side of said workpiece has at least one substantially flat peripheral edge, and said nozzles are adapted to eject said cleaning solution on a portion of said substantially flat peripheral edge which is positioned downstream of other portions of the substantially flat peripheral edge with respect to the direction of rotation of the chuck.

17. A cleaning device according to claim 10, wherein said applying means intermittently applies said cleaning solution through said nozzles in said timed relationship.

18. A cleaning device for cleaning a reverse side of planar workpiece whose face side is coated with a coating solution, comprising:

a rotatable chuck for holding the planar workpiece thereon;

a pair of nozzles disposed on a concentric circle about said rotatable chuck for alternately applying a cleaning solution to the peripheral edge on the reverse side of the workpiece; and actuator means for rotating said rotatable chuck with the workpiece held thereon alternatively in opposite directions such that the cleaning solution is ejected from one of said nozzles while said rotatable chuck is being rotated in one of said opposite directions by said actuator means, and the cleaning solution is ejected from the other of said nozzles while said rotatable chuck is being rotated in the other of said opposite directions by said actuator means;

said nozzles having respective axes along which the cleaning solution is ejected, said axes extending symmetrically with respect to a line passing through the center of said rotatable chuck perpendicularly to a line connecting the pair of nozzles.

19. A cleaning device according to claim 18, including means for ejecting cleaning solution alternately from said nozzles while said rotatable chuck with the workpiece held thereon is being rotated alternately in opposite directions, and said nozzles are adapted to eject said cleaning solution on portions of said reverse side of the workpiece which are positioned downstream of other portions of the reverse side of the workpiece with respect to the direction of rotation of the chuck.

* * * * *

UNITED STATES PATENT AND TRADEMARK OFFICE

CERTIFICATE OF CORRECTION

PATENT NO. : 5,349,978
DATED : September 27, 1994
INVENTOR(S) : Sago et al.

It is certified that error appears in the above-indentified patent and that said Letters Patent is hereby corrected as shown below:

Column 4, line 53, delete "placed".

Signed and Sealed this

Fifteenth Day of November, 1994

*Attest:*

BRUCE LEHMAN

*Attesting Officer*

*Commissioner of Patents and Trademarks*